US009751539B2

(12) United States Patent
Hirashima et al.

(10) Patent No.: US 9,751,539 B2
(45) Date of Patent: Sep. 5, 2017

(54) SIDE BODYSHELL OF RAILCAR

(71) Applicant: KAWASAKI JUKOGYO KABUSHIKI KAISHA, Kobe-shi, Hyogo (JP)

(72) Inventors: Toshiyuki Hirashima, Kobe (JP); Shirou Honma, Kobe (JP); Hitoshi Nagahara, Kobe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 183 days.

(21) Appl. No.: 14/437,804

(22) PCT Filed: Oct. 17, 2013

(86) PCT No.: PCT/JP2013/006154
§ 371 (c)(1),
(2) Date: Apr. 22, 2015

(87) PCT Pub. No.: WO2014/064908
PCT Pub. Date: May 1, 2014

(65) Prior Publication Data

US 2015/0291185 A1 Oct. 15, 2015

(30) Foreign Application Priority Data

Oct. 24, 2012 (JP) ..... 2012-234593

(51) Int. Cl.
*B61D 17/08* (2006.01)

(52) U.S. Cl.
CPC ..... *B61D 17/08* (2013.01)

(58) Field of Classification Search
CPC ... B61D 1/00; B61D 7/00; B61D 7/04; B61D 7/041; B61D 7/043; B61D 7/045; B61D 7/048; B61D 7/08
See application file for complete search history.

(56) References Cited

U.S. PATENT DOCUMENTS 4,995,321 A * 2/1991 Ohmura ..... B61D 1/00 105/396
2010/0089283 A1 4/2010 Kono et al.

FOREIGN PATENT DOCUMENTS

CN 202038312 U 11/2011
JP 59-29355 U 2/1984
JP 59-143868 U 9/1984
(Continued)

OTHER PUBLICATIONS

May 26, 2016 Office Action issued in Chinese Patent Application No. 201380054367.5.
(Continued)

*Primary Examiner* — R. J. McCarry, Jr.
(74) *Attorney, Agent, or Firm* — Oliff PLC

(57) ABSTRACT

A side bodyshell of a railcar includes: an outside plate including a window opening; horizontal frames arranged below the window opening and joined to the outside plate; and a vertical frame crossing the horizontal frames in a manner to pass over a pier panel, which is lateral to the window opening. The vertical frame includes: a first flange joined to the outside plate at the pier panel; and a second flange spaced apart from the outside plate below the first flange such that a step is formed between the first flange and the second flange, the second flange being joined to the horizontal frames.

10 Claims, 5 Drawing Sheets

(56) References Cited

FOREIGN PATENT DOCUMENTS

| | | | |
|---|---|---|---|
| JP | H9-30414 | A | 2/1997 |
| JP | 2006-27366 | A | 2/2006 |
| JP | 2006-347358 | A | 12/2006 |
| JP | 2008-126758 | A | 6/2008 |
| WO | 2008/068860 | A1 | 6/2008 |

OTHER PUBLICATIONS

Dec. 17, 2013 International Search Report issued in International Application No. PCT/JP2013/006154.

* cited by examiner

SIDE BODYSHELL OF RAILCAR

TECHNICAL FIELD

The present invention relates to a side bodyshell of a railcar, in which horizontal frames and vertical frames are disposed on the inside of an outside plate.

BACKGROUND ART

Conventionally, there is a known side bodyshell with a so-called floating frame structure, in which horizontal frames are joined to an outside plate, and over the horizontal frames, vertical frames are provided across the horizontal frames. For example, Patent Literature 1 discloses a side bodyshell of a railcar, in which: an outside plate includes a window opening and an entrance opening, which are arranged alternately in the railcar longitudinal direction; two types of horizontal frames having different heights from each other (the term height means a protruding dimension of each horizontal frame protruding inward in the railcar width direction from the outside plate) are joined to the outside plate.

Specifically, the side bodyshell disclosed in Patent Literature 1 includes a pair of first horizontal frames having a great height. One of the first horizontal frames is disposed immediately above the window opening of the outside plate, and the other first horizontal frame is disposed immediately below the window opening. Second horizontal frames having a small height are arranged between these first horizontal frames (i.e., on a pier panel between the window opening and the entrance opening), and also arranged above and below the first horizontal frames. Vertical frames are provided in a manner to cross these horizontal frames. Such a vertical frame is divided up at positions corresponding to the pair of first horizontal frames into an upper vertical frame portion, a middle vertical frame portion, and a lower vertical frame portion. These vertical frame portions are connected to each other via coupling members.

Each vertical frame portion has a hat-shaped cross section and includes flanges. The flanges of each vertical frame portion are joined to second horizontal frames. The coupling members, which connect the vertical frame portions together, extend in the railcar longitudinal direction along the first horizontal frames, such that each coupling member covers a gap between vertical frame portions from inside in the railcar width direction. Both ends of the coupling members are joined to the first horizontal frames.

Patent Literature 2 discloses a bodyshell frame structure of a railcar, in which horizontal frames are arranged in priority to vertical frames, and the vertical frames are brought into contact with and welded to the horizontal frames. According to Patent Literature 2, owing to such a structure, the horizontal frames can be provided continuously in the railcar longitudinal direction without causing the horizontal frames to be divided up by the vertical frames, and the number of horizontal frames can be minimized since the horizontal frames need not be divided up.

CITATION LIST

Patent Literature

PTL 1: Japanese Laid-Open Patent Application Publication No. 2008-126758

PTL 2: Japanese Laid-Open Patent Application Publication No. 2006-347358

SUMMARY OF INVENTION

Technical Problem

However, in the side bodyshell disclosed in Patent Literature 1, the vertical frames are spaced apart from the outside plate. Therefore, there are cases where the strength of the outside plate in the out-of-plane direction and the shearing direction is insufficient at a narrow pier panel of the outside plate, the narrow pier panel being adjacent to an opening such as a window opening. The side bodyshell has a structure in which horizontal frames are disposed on such a narrow pier panel. Therefore, the work of joining the horizontal frames is complex and cumbersome, and in addition, the number of components increases.

While a fundamental structure disclosed in Patent Literature 2 is such that vertical frames are welded to horizontal frames, Patent Literature 2 also discloses a structure in which, near an opening, one of the flanges of a vertical frame is joined to end portions of horizontal frames, and the other flange of the vertical frame is joined to the outside plate. However, the technique of Patent Literature 2 is assumed to be applied to a structure in which horizontal frames are disposed on a pier panel.

In view of the above, an object of the present invention is to provide a side bodyshell of a railcar with a simple structure in which vertical frames are not divided up, the side bodyshell making it possible to improve the strength of the outside plate at its pier panel.

Solution to Problem

In order to solve the above-described problems, a side bodyshell of a railcar according to the present invention includes: an outside plate including a window opening; horizontal frames arranged below the window opening and joined to the outside plate; and a vertical frame crossing the horizontal frames in a manner to pass over a pier panel, which is lateral to the window opening. The vertical frame includes: a first flange joined to the outside plate at the pier panel; and a second flange spaced apart from the outside plate below the first flange such that a step is formed between the first flange and the second flange, the second flange being joined to the horizontal frames.

According to the above-described configuration, the vertical frame is joined to the outside plate at the pier panel. This makes it possible to improve the strength of the outside plate at the pier panel.

Advantageous Effects of Invention

The present invention makes it possible to provide a side bodyshell of a railcar with a simple structure in which vertical frames are not divided up, the side bodyshell making it possible to improve the strength of the outside plate at its pier panel.

DESCRIPTION OF EMBODIMENTS

Hereinafter, embodiments are described with reference to the drawings.

Figure 1:
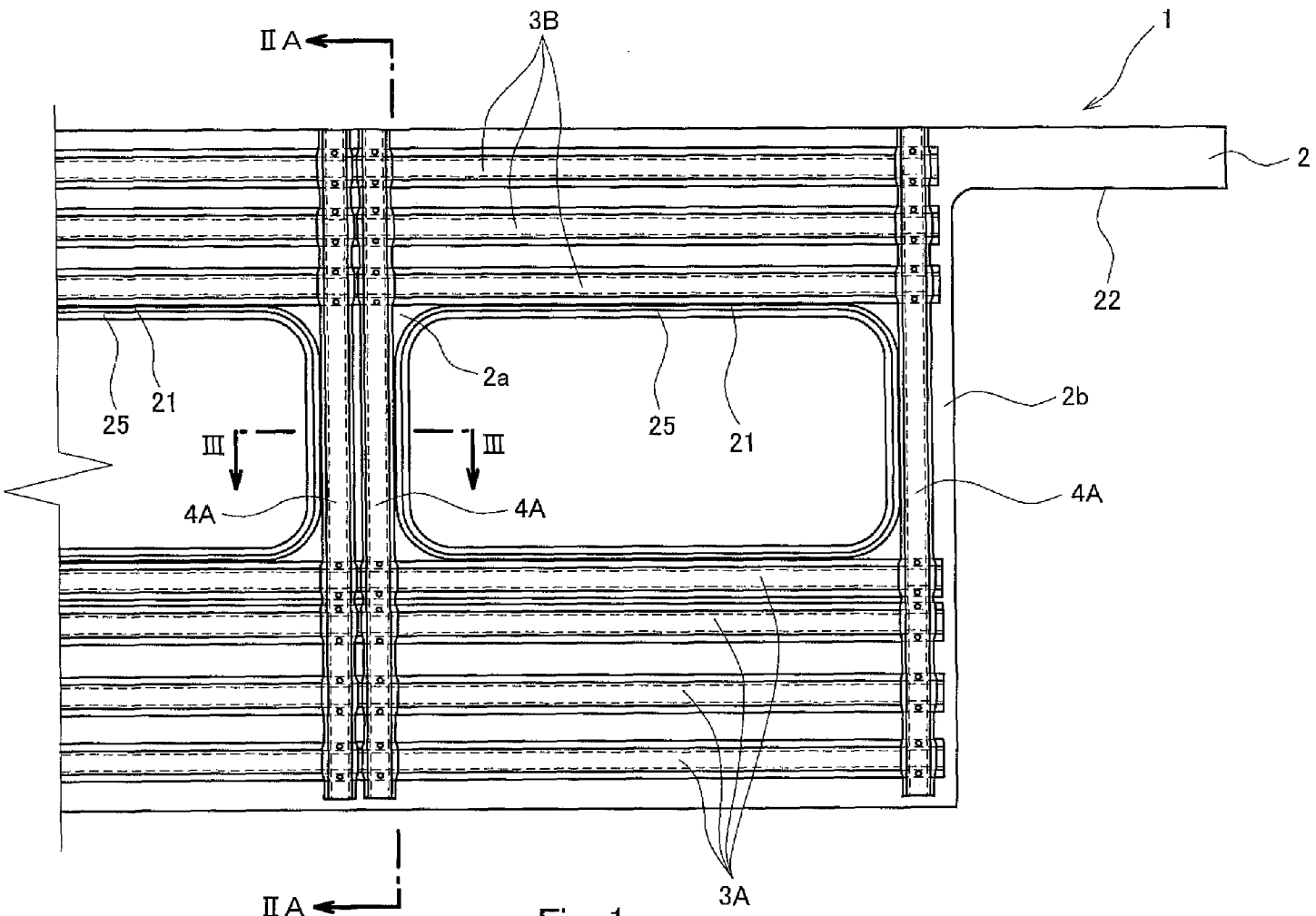
FIG. 1 shows a side bodyshell of a railcar according to one embodiment, which is seen from inside in the railcar width direction.
Figure 2A:
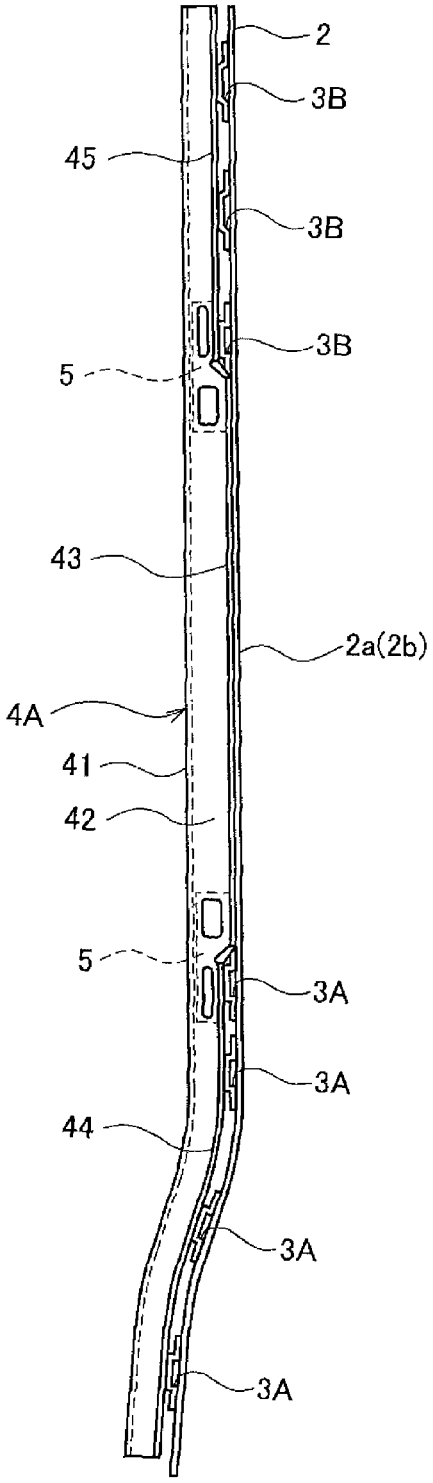
FIG. 2A is a sectional view of the side bodyshell taken along line IIA-IIA of FIG. 1.
Figure 2B:
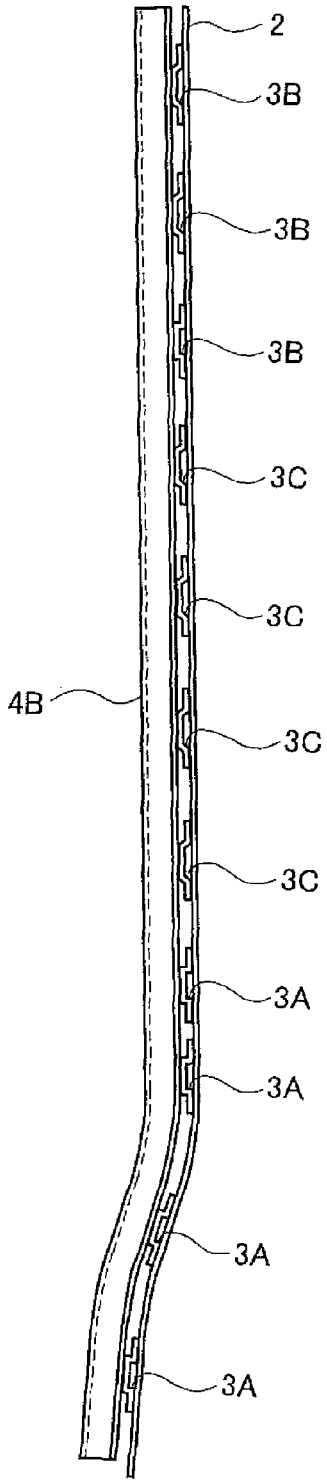
FIG. 2B is a sectional view of a part of the side bodyshell where no window openings are arranged.
Figure 3:
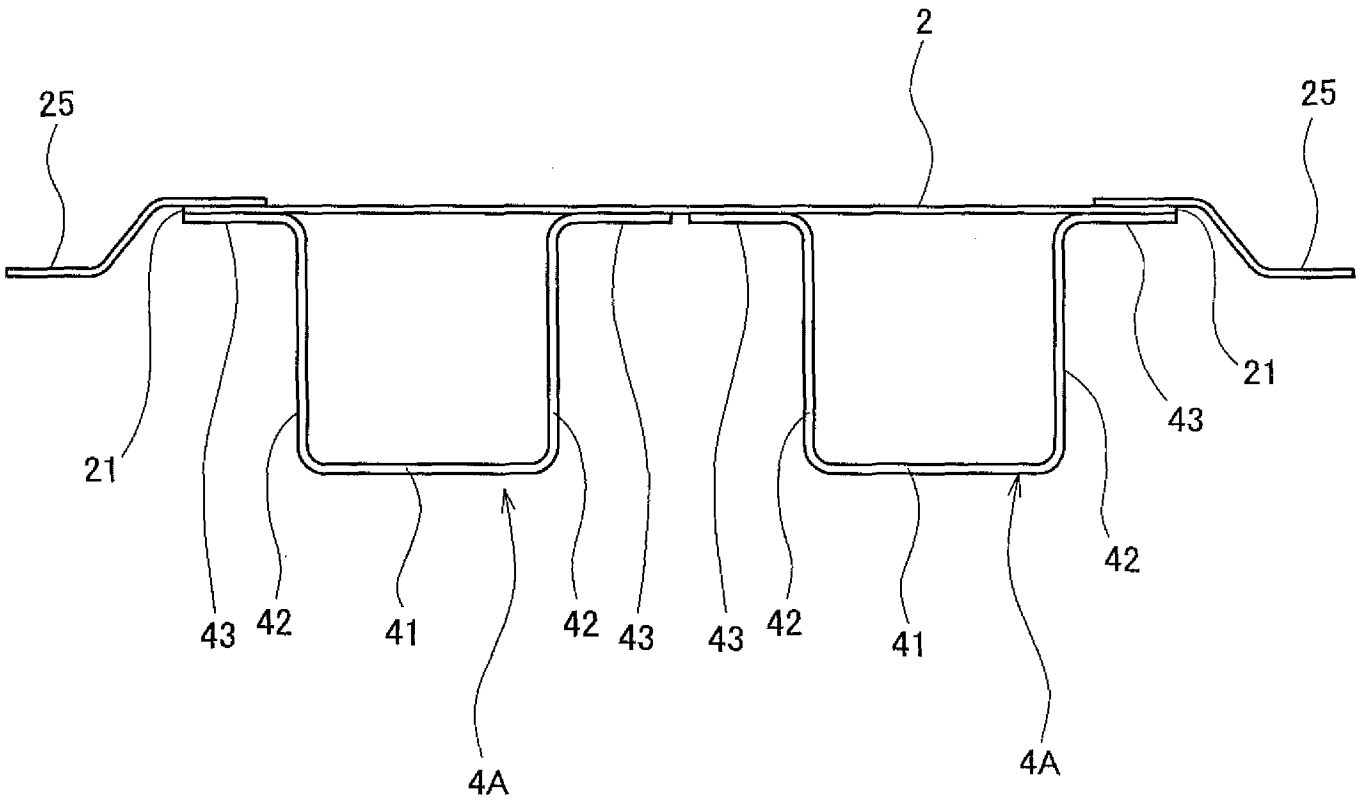
FIG. 3 is a sectional view of the side bodyshell taken along line III-III of FIG. 1.

Each of FIG. 1 to FIG. 3 shows a side bodyshell 1 of a railcar according to one embodiment. The side bodyshell 1 includes an outside plate 2. The outside plate 2 includes window openings 21 and an entrance opening 22.

In the present embodiment, the side bodyshell 1 has a configuration in which the outside plate 2 includes at least one pair of window openings 21 adjacent to each other. The term "adjacent" herein means that the distance between the window openings 21 has a width that allows, for example, one vertical frame or two vertical frames to be disposed between the window openings 21. It should be noted that the thickness and width of the vertical frame may be changed as necessary, so long as the vertical frame has bending strength necessary for functioning as a reinforcing member for the outside plate. As one example, the thickness and width of the vertical frame are set such that its section modulus around a horizontal axis becomes approximately 4000 to 8000 $mm^3$. In the present embodiment, the window openings 21 are arranged side by side at a pitch slightly greater than the width of the window opening 21, and the window opening 21 that is positioned at the end is adjacent also to the entrance opening 22. Accordingly, no horizontal frames are disposed on a first pier panel 2*a* between the window openings 21, and also, no horizontal frames are disposed on a second pier panel 2*b* between the window opening 21 and the entrance opening 22. Framing members 25, each of which rims one of the window openings 21, are fixed to the outside plate 2 as shown in FIG. 3.

Lower horizontal frames 3A (in the illustrated example, four lower horizontal frames 3A) are arranged below the window openings 21, and upper horizontal frames 3B (in the illustrated example, three upper horizontal frames 3B) are arranged above the window openings 21. FIG. 1 only shows a part of the side bodyshell 1 where the window openings 21 are arranged side by side. In a part of the side bodyshell 1 where no window openings 21 are arranged, as shown in FIG. 2B, middle horizontal frames 3C (in the illustrated example, four middle horizontal frames 3C) are arranged in an area that corresponds to the window opening 21. These horizontal frames 3A to 3C are joined to the outside plate 2. In the present embodiment, the side bodyshell 1 includes a plurality of the entrance openings 22, and the window openings 21 are disposed between the entrance openings 22. The lower horizontal frames 3A extend continuously without being divided up between the entrance openings 22. The wording "extend continuously" herein means that each lower horizontal frame 3A is formed as a seamless unit, or that a plurality of lower horizontal frames 3A are connected together by a coupling whose section modulus is substantially the same as that of the lower horizontal frames 3A.

First vertical frames 4A pass over the first pier panel 2*a* and the second pier panel 2*b*. A second vertical frame 4B (see FIG. 2B) passes over neither of the pier panels, but passes over a different portion. That is, each first vertical frame 4A crosses the lower horizontal frames 3A and the upper horizontal frames 3B, and the second vertical frame 4B crosses the lower horizontal frames 3A, the middle horizontal frames 3C, and the upper horizontal frames 3B. Two first vertical frames 4A are disposed on the first pier panel 2*a*, and one first vertical frame 4A is disposed on the second pier panel 2*b*.

As shown in FIGS. 2A and 2B, the outside plate 2 has an S-shaped contour (i.e., an S-shaped outline), such that its wainscot portion is offset inward in the railcar width direction. Similar to the outside plate 2, the lower portion of the first vertical frame 4A and the lower portion of the second vertical frame 4B are bent to be S-shaped and offset inward in the railcar width direction. That is, each of the outside plate 2, the first vertical frame 4A, and the second vertical frame 4B, from their central portion toward their lower end, bends inward first in the railcar width direction and then bends downward.

In the present embodiment, all of the horizontal frames 3A to 3C and the vertical frames 4A and 4B have a hat-shaped cross section. However, as an alternative, part or all of the horizontal frames 3A to 3C and the vertical frames 4A and 4B may have a crank-shaped or Z-shaped cross section.

The second vertical frame 4B has a constant cross-sectional shape over its entire length, and is joined only to the lower horizontal frames 3A, the middle horizontal frames 3C, and the upper horizontal frames 3B, but not to the outside plate 2. On the other hand, each first vertical frame 4A is formed such that its middle portion protrudes outward in the railcar width direction relative to its upper and lower portions. The lower portion of each first vertical frame 4A is joined to the lower horizontal frames 3A, and the upper portion of each first vertical frame 4A is joined to the upper horizontal frames 3B. The middle portion of each first vertical frame 4A is joined to the outside plate 2 at either the pier panel 2*a* or the pier panel 2*b*.

More specifically, as shown in FIG. 2A, each first vertical frame 4A includes: a pair of first flanges 43 (see FIG. 3) joined to the outside plate 2 at the first pier panel 2*a* or the second pier panel 2*b*; a pair of second flanges 44 joined to the lower horizontal frames 3A; and a pair of third flanges 45 joined to the upper horizontal frames 3B. Although the object to which the third flanges 45 are joined and the object to which the second flanges 44 are joined are different from each other, except this difference, the configuration of the third flanges 45 and the relationship between the first flanges 43 and the third flanges 45 are the same as the configuration of the second flanges 44 and the relationship between the first flanges 43 and the second flanges 44. Therefore, the description given below with reference to FIGS. 4A to 4C focuses on the relationship between the first flanges 43 and the second flanges 44.

Figure 4A:
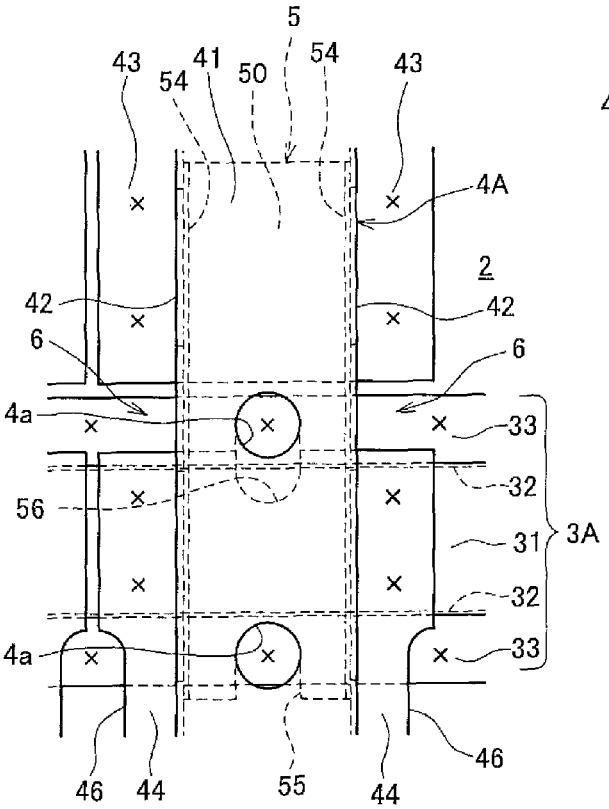
FIG. 4A shows an essential part of FIG. 1.
Figure 4B:
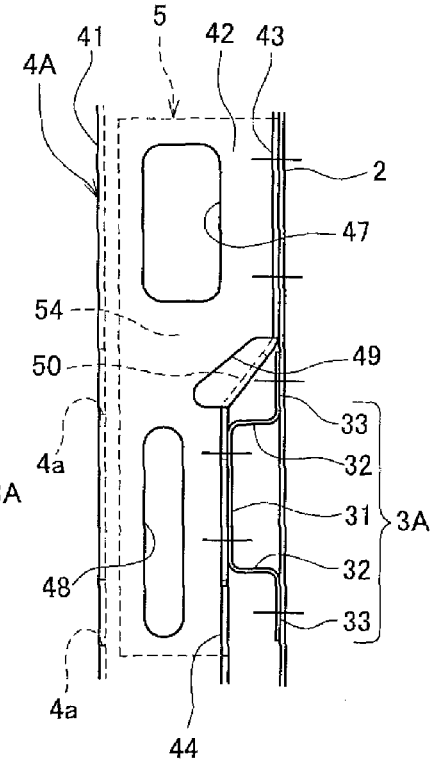
FIG. 4B is a side sectional view of the essential part.
Figure 4C:
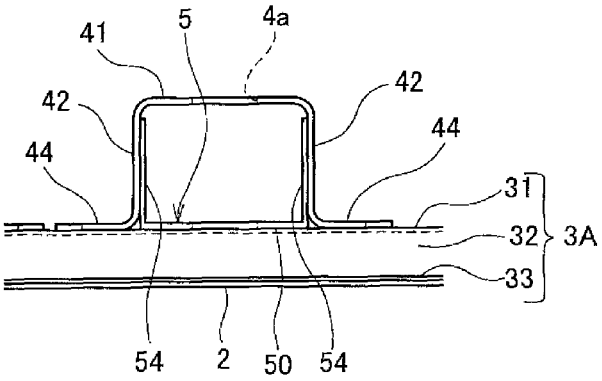
FIG. 4C is a bottom sectional view of the essential part.

As shown in FIGS. 4A to 4C, the second flanges 44 are spaced apart from the outside plate 2 below the first flanges 43, such that a step is formed between the first flanges 43 and the second flanges 44. The distance from the second flanges 44 to the outside plate 2 is equal to the height of the lower horizontal frames 3A.

Each lower horizontal frame 3A includes: a pair of flanges 33 joined to the outside plate 2; a main wall 31 spaced apart from the outside plate 2 and facing the outside plate 2; and a pair of side walls 32 extending from the upper and lower ends of the main wall 31 and connecting to the flanges 33. The second flanges 44 of the first vertical frame 4A are joined to the main wall 31 of each lower horizontal frame 3A, such that the second flanges 44 are in surface contact with the main wall 31. It should be noted that the angle that each side wall 32 forms with the main wall 31 may be a right angle or an obtuse angle.

In addition to the first to third flanges 43 to 45, the first vertical frame 4A includes: a main wall 41, which extends over and beyond all the horizontal frames 3A and 3B in parallel to the outside plate 2; and a pair of side walls 42 extending from the right and left ends of the main wall 41 and connecting to the first to third flanges 41 to 43. It should be noted that it is not essential that the main wall 41 be fully parallel to the outside plate 2 over the entire length of the main wall 41. It will suffice if the main wall 41 is substantially parallel to the outside plate 2. For example, the distance between the main wall 41 and the outside plate 2 may slightly vary at some point.

In the present embodiment, a gap 6 is formed between the first flanges 43 and the second flanges 44 in a direction in which the main wall 41 extends. A cut 49 is formed in each of the side walls 42, such that the cut 49 is recessed toward the main wall 41 from the gap 6. Accordingly, the first vertical frame 4A can be manufactured by folding a metal plate (e.g., by brake press forming).

In the present embodiment, the joining between the outside plate 2 and the first flanges 43 of the first vertical frame 4A, the joining between the outside plate 2 and the flanges 33 of the lower horizontal frames 3A, and the joining between the second flanges 44 of the first vertical frame 4A and the main walls 31 of the lower horizontal frames 3A, are performed by spot welding. For example, spot welding may be performed in a manner to sandwich the lower horizontal frames 3A and the outside plate 2 with electrodes from both sides. Then the first vertical frame 4A may be placed on the lower horizontal frames 3A, and spot welding (series spot welding) may be performed in a manner to place electrodes only on the first vertical frame 4A from one side. In this case, however, a great load is applied to the lower horizontal frames 3A when the series spot welding is performed. Therefore, in this case, it is necessary that the lower horizontal frames 3A have a great thickness so that the lower horizontal frames 3A can bear the load. In this respect, the thickness of the lower horizontal frames 3A can be reduced by adopting the following manner of spot welding: first, perform spot welding in a manner to sandwich the first vertical frame 4A and the lower horizontal frames 3A with electrodes from both sides, thereby fabricating a framework; and thereafter, place the framework on the outside plate 2 and perform spot welding in a manner to sandwich the lower horizontal frames 3A and the outside plate 2 with electrodes from both sides. The present embodiment adopts a configuration that makes it possible to perform the spot welding in a manner to sandwich the lower horizontal frames 3A and the outside plate 2 with electrodes from both sides even in the case where the framework is fabricated first.

Specifically, through-holes 4*a*, in which electrodes for use in spot welding can be inserted, are formed in the main wall 41 of the first vertical frame 4A at positions where the main wall 41 overlaps the flanges 33 of the lower horizontal frames 3A. In addition, cuts 46 are formed in the second flanges 44 of the first vertical frame 4A for the purpose of forming openings between the first vertical frames 4A that are adjacent to each other on the first pier panel 2*a*. Through the openings, electrodes for use in spot welding can be inserted. By utilizing these through-holes 4*a* and cuts 46, spot welding is performed between the outside plate 2 and the flanges 33 of the lower horizontal frames 3A. For the spot welding between the outside plate 2 and the upper flange 33 of the uppermost lower horizontal frame 3A, the gap 6 between the first flanges 43 and the second flanges 44 of the first vertical frame 4A is utilized at positions corresponding to the cuts 46 when performing the spot welding. Adopting this configuration makes it possible to prevent a problem in that the presence of the first vertical frame 4A undesirably causes widening of the welding spacing for the spot welding between the outside plate 2 and the lower horizontal frames 3A. Positions where the spot welding is performed in the present embodiment are indicated by x marks in FIG. 4A and short solid lines in FIG. 4B.

The gap 6 between the first flanges 43 and the second flanges 44 and the cuts 49 formed in the side walls 42 cause a reduction in the section modulus of the first vertical frame 4A. Accordingly, a reinforcing member 5 serving to compensate for the reduction in the section modulus of the first vertical frame 4A is provided inside the first vertical frame 4A.

The reinforcing member 5 has a U-shaped cross section, and is open inward in the railcar width direction. The reinforcing member 5 extends both upward and downward from the cuts 49. More specifically, the reinforcing member 5 includes: a reinforcing wall 50 spanning between the first flanges 43 and the second flanges 44 and facing the main wall 41 of the first vertical frame 4A; and a pair of guide walls 54 rising from the right and left ends of the reinforcing wall 50 along the side walls 42 of the first vertical frame 4A.

In the side walls 42 of the first vertical frame 4A, openings 47 are formed above the cuts 49, and openings 48 are formed below the cuts 49. Through these openings, the guide walls 54 of the reinforcing member 5 are exposed. At least part of rim portions of the reinforcing member 5, which rim the openings 47 and 48 in the side walls 42, is fillet-welded to the guide walls 54, and thereby the reinforcing member 5 is fixed to the first vertical frame 4A.

Figure 5:
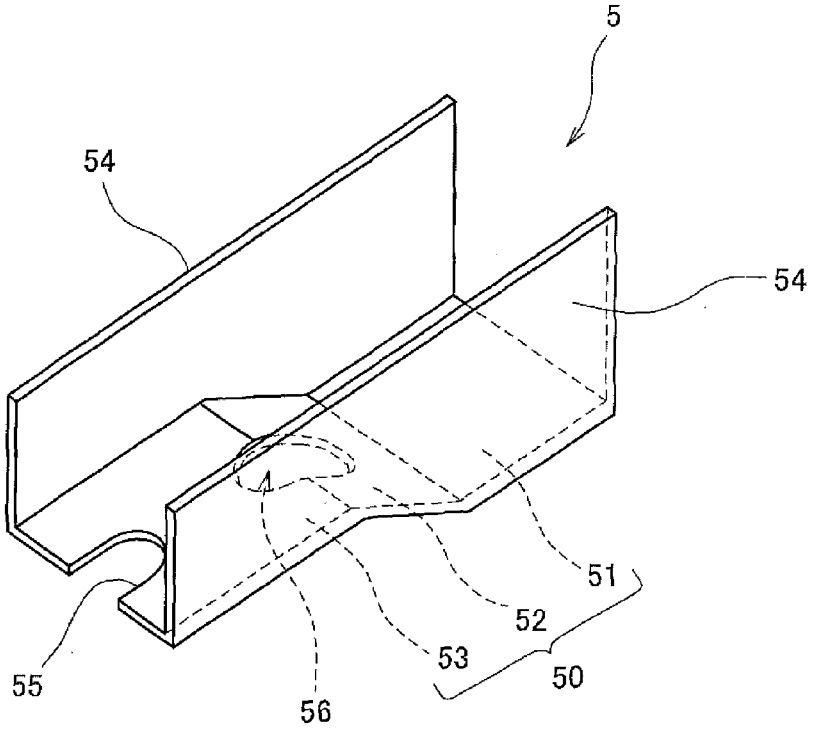
FIG. 5 is a perspective view of a reinforcing member used in the side bodyshell shown in FIG. 1.

As shown in FIG. 5, the reinforcing wall 50 includes: a first flat portion 51 positioned on the same plane with the first flanges 43; a second flat portion 53 positioned on the same plane with the second flanges 44; and a sloped portion 52, which connects between the lower side of the first flat portion 51 and the upper side of the second flat portion 53. The lower side of the first flat portion 51 is positioned substantially at the same height as the lower end of the first flanges, and the upper side of the second flat portion 53 is positioned substantially at the same height as the upper end of the second flanges 44. A cut 55 and an elongated hole 56, through which electrodes for use in spot welding can be inserted, are formed in the reinforcing wall 50 at positions corresponding to the through-holes 4*a* formed in the main wall 41 of the first vertical frame 4A.

As mentioned above, the third flanges 45, which are joined to the upper horizontal frames 3B, are configured in the same manner as the second flanges 44. Accordingly, as shown in FIG. 2A, the reinforcing member 5 is disposed not only at the boundary between the first flanges 43 and the second flanges 44, but also at the boundary between the first flanges 43 and the third flanges 45.

As described above, in the side bodyshell 1 according to the present embodiment, the first vertical frames 4A are joined to the outside plate 2 at the first pier panel 2*a* and the second pier panel 2*b*. This makes it possible to improve the strength of the outside plate 2 at the first pier panel 2*a* and the second pier panel 2*b*. That is, the pier panels can be strengthened while making use of the advantage of the floating frame structure, i.e., the advantage that both the horizontal frames and the vertical frames can be arranged continuously.

In particular, in a case where no horizontal frames are disposed on the pier panels as in the present embodiment, the rigidity of the side bodyshell 1 at the pier panels can be sufficiently obtained by joining the first vertical frames 4A and the outside plate 2 together. In other words, the horizontal frames can be eliminated from the pier panels by joining the first vertical frames 4A and the outside plate 2 together.

There are cases where a door pocket post and a door stop post are disposed at the second pier panel 2*b* between the window opening 21 and the entrance opening 22. However, such posts are rarely disposed at the first pier panel 2*a* between the window openings 21. Therefore, the configuration of the first vertical frame 4A is particularly effective for the first pier panel 2*a*.

In the side bodyshell 1 according to the present embodiment, the cross section of the first vertical frame 4A is hat-shaped, and the first to third flanges 43 to 45 and the side walls 42 are provided on both sides of the main wall 41. This makes it possible to support the outside plate 2 at the first pier panel 2*a* and the second pier panel 2*b* with high strength.

Further, in the side bodyshell 1 according to the present embodiment, the through-holes 4*a* are formed in the main wall 41 of the first vertical frame 4A. Therefore, even at the positions where the first vertical frame 4A overlaps the lower horizontal frames 3A, the lower horizontal frames 3A and the outside plate 2 can be spot-welded together.

As in the present embodiment, by adopting the S-shaped contour structure in which the wainscot portion of the outside plate 2 is offset inward in the railcar width direction and also adopting the floating frame structure in which the horizontal frames and the vertical frames are arranged continuously, the strength of the outside plate can be obtained sufficiently, and the side bodyshell that can be readily manufactured can be realized. In particular, the side bodyshell according to the present embodiment has a structure in which the horizontal frames are prioritized and the horizontal frames are not divided up due to the presence of the vertical frames. Therefore, the side bodyshell according to the present embodiment has sufficient strength against a car end compressive load.

(Variation)

The present invention is not limited to the above-described embodiment. Various modifications can be made without departing from the spirit of the invention.

For example, it is not essential for the window opening 21 to be adjacent to the entrance opening 22. The window opening 21 may be positioned away from the entrance opening 22 by a distance greater than or equal to the half of the width of the window opening 21. In this case, the middle horizontal frames 3C (see FIG. 2B) may be disposed on the second pier panel 2*b*.

Further, for example, in a case where the window opening 21 is large, the upper horizontal frames 3B may be eliminated, and only a cant rail may be disposed instead of the upper horizontal frames 3B. That is, the third flanges 45 may be eliminated from the first vertical frame 4A, and the first flanges 43 may extend to the upper end of the first vertical frame 4A.

Still further, the method of joining among the lower horizontal frames 3A, the first vertical frame 4A, and the outside plate 2 is not limited to spot welding, but may be laser welding.

Figure 6:
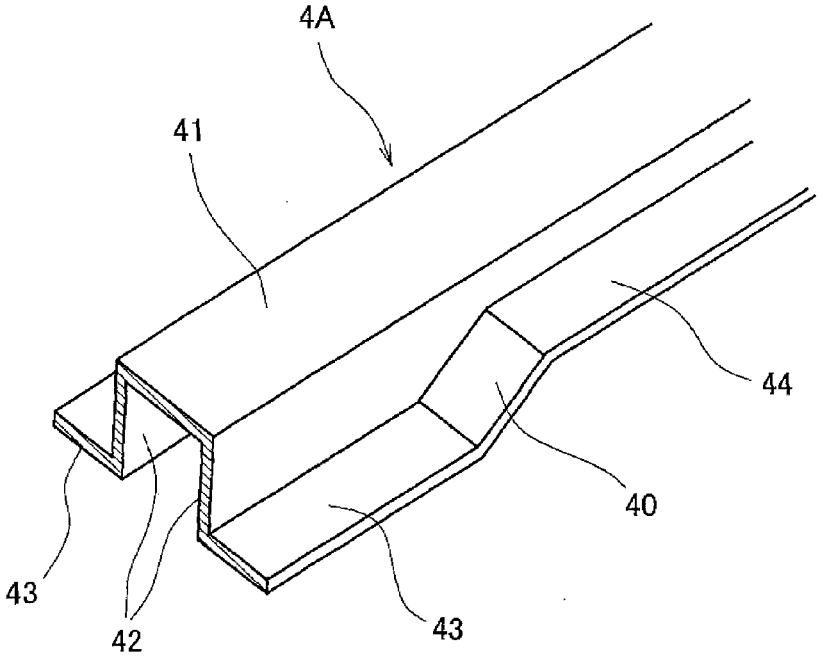
FIG. 6 is a perspective view showing a vertical frame according to a variation of the embodiment.

Still further, it is not essential that the gap 6 be formed between the first flanges 43 and the second flanges 44 of the first vertical frame 4A in the direction in which the main wall 41 extends. For example, as shown in FIG. 6, the first vertical frame 4A may be provided with connection portions 40, which connect between the first flanges 43 and the second flanges 44. After forming the first flanges 43 and the second flanges 44 by folding, the connection portions 40 may be welded to the first flanges 43 and the second flanges 44. Alternatively, these portions may be integrally formed by drawing press forming if the material and thickness of these portions allow the application of such forming method. By adopting such a structure, the reinforcing member 5 can be eliminated. It should be noted that if the gap 6 is formed between the first flanges 43 and the second flanges 44 as in the above-described embodiment, the first vertical frame 4A can be manufactured only by folding.

REFERENCE SIGNS LIST

1 side bodyshell
2 outside plate
2*a* first pier panel
2*b* second pier panel
21 window opening
3A to 3C horizontal frame
31 main wall
32 side wall
33 flange
4A, 4B vertical frame
4*a* through-hole
41 main wall
42 side wall
43 first flange
44 second flange
5 reinforcing member
50 reinforcing wall
6 gap

The invention claimed is:

1. A side bodyshell of a railcar, the side bodyshell comprising:
an outside plate including a window opening;
horizontal frames arranged below the window opening and joined to the outside plate; and
a vertical frame crossing the horizontal frames in a manner to pass over a pier panel, which is lateral to the window opening, wherein
the vertical frame includes:
a first flange joined to the outside plate at the pier panel; and
a second flange spaced apart from the outside plate below the first flange such that a step is formed between the first flange and the second flange, the second flange being joined to the horizontal frames.

2. The side bodyshell of a railcar according to claim 1, wherein
the outside plate includes at least a pair of the window openings adjacent to each other, and
the pier panel is positioned between the pair of the window openings.

3. The side bodyshell of a railcar according to claim 1, wherein
no horizontal frames are disposed on the pier panel.

4. The side bodyshell of a railcar according to claim 1, wherein
the outside plate includes at least two entrance openings, the window opening is disposed between the entrance openings, and the horizontal frames extend continuously from one of the entrance openings to the other entrance opening.

5. The side bodyshell of a railcar according to claim 1, wherein the vertical frame includes:

a vertical main wall extending parallel to the outside plate; and a vertical side wall extending from an end portion of the vertical main wall and connecting to the first flange and the second flange, and a gap is formed between the first flange and the second flange in a direction in which the vertical main wall extends.

6. The side bodyshell of a railcar according to claim 5, wherein a reinforcing member is fixed to the vertical frame, the reinforcing member including a reinforcing wall, the reinforcing wall spanning between the first flange and the second flange and facing the vertical main wall.

7. The side bodyshell of a railcar according to claim 5, wherein the first flange, the second flange, and the vertical side wall are provided on each of both sides of the vertical main wall.

8. The side bodyshell of a railcar according to claim 5, wherein each of the horizontal frames includes:

a flange joined to the outside plate;

a horizontal main wall spaced apart from the outside plate and facing the outside plate; and a horizontal side wall extending from an end portion of the horizontal main wall and connecting to the flange, and through-holes are formed in the vertical main wall of the vertical frame at positions where the vertical main wall overlaps the flanges of the respective horizontal frames.

9. The side bodyshell of a railcar according to claim 1, wherein a lower portion of the outside plate and a lower portion of the vertical frame are bent to be offset inward in a width direction of the railcar.

10. The side bodyshell of a railcar according to claim 5, wherein a distance from the vertical main wall to the first flange is greater than a distance from the vertical main wall to the second flange.

* * * * *